US011815344B2

(12) United States Patent
Sasnett et al.

(10) Patent No.: US 11,815,344 B2
(45) Date of Patent: Nov. 14, 2023

(54) MODULAR DISRUPTION SYSTEMS FOR EXPLOSIVE ORDNANCE DISPOSAL

(71) Applicant: Zero Point, Incorporated, Virginia Beach, VA (US)

(72) Inventors: Perry Allen Sasnett, Virginia Beach, VA (US); Michael Danforth Lincoln, Litchfield, NH (US); Joshua Keith Brammer, Virginia Beach, VA (US)

(73) Assignee: Zero Point, Incorporated, Virginia Beach, VA (US)

( * ) Notice: Subject to any disclaimer, the term of this patent is extended or adjusted under 35 U.S.C. 154(b) by 0 days.

(21) Appl. No.: 17/245,843

(22) Filed: Apr. 30, 2021

(65) Prior Publication Data

US 2021/0404785 A1 Dec. 30, 2021

Related U.S. Application Data

(60) Provisional application No. 63/018,590, filed on May 1, 2020.

(51) Int. Cl.
*F42D 5/04* (2006.01)

(52) U.S. Cl.
CPC ..... *F42D 5/04* (2013.01)

(58) Field of Classification Search
CPC ..... F42D 5/04; F42B 33/06; F41B 9/0043; F41B 9/0046; F42C 15/44
See application file for complete search history.

(56) References Cited

U.S. PATENT DOCUMENTS 4,169,403 A * 10/1979 Hanson ..... F41B 9/0046 102/293
5,136,920 A * 8/1992 Breed ..... F41A 23/06 102/502
5,210,368 A * 5/1993 Heller, Jr. ..... F42B 33/06 42/84
5,460,154 A * 10/1995 Mattern ..... F41B 9/0021 124/75
5,515,767 A * 5/1996 Gilbert ..... F41B 9/0046 89/1.701
5,736,669 A * 4/1998 Thomas ..... B09C 1/10 102/293
6,490,957 B1 * 12/2002 Alexander ..... F41B 11/71 102/275.11
6,644,166 B2 * 11/2003 Alexander ..... F41B 11/71 248/160
8,245,430 B1 * 8/2012 Owenby ..... F41A 19/69 42/84

(Continued)

*Primary Examiner* — Joshua E Freeman
(74) *Attorney, Agent, or Firm* — TROUTMAN PEPPER HAMILTON SANDERS LLP; James E. Schutz; Jacob M. Burr

(57) ABSTRACT

A modular disruption system is described. The modular disruption system can include one or more interchangeable barrel sections, each interchangeable barrel section being configured to support a different ammunition caliber. The modular disruption system can also include one or more interchangeable chamber sections, each interchangeable chamber section being configured to support a different ammunition caliber. Each interchangeable chamber section can be configured to detachably attach to each interchangeable barrel section.

20 Claims, 2 Drawing Sheets

(56) References Cited

U.S. PATENT DOCUMENTS

| | | | | |
|---|---|---|---|---|
| 8,276,495 | B1 * | 10/2012 | Chiu | F41A 21/485 89/7 |
| 9,200,881 | B1 * | 12/2015 | Langner | F42B 33/06 |
| 9,404,718 | B1 * | 8/2016 | Shaver | F41A 3/04 |
| 9,453,713 | B1 * | 9/2016 | Langner | F42B 33/001 |
| 9,488,429 | B1 * | 11/2016 | Langner | F41A 25/26 |
| 9,587,909 | B1 * | 3/2017 | Askin | F41F 1/00 |
| 10,066,916 | B1 * | 9/2018 | Vabnick | F42B 12/82 |
| 10,495,433 | B1 * | 12/2019 | Langner | F41H 11/12 |
| 10,704,881 | B1 * | 7/2020 | Foltz | F42B 33/06 |
| 10,712,140 | B2 * | 7/2020 | Sasnett | F41A 23/02 |
| 10,794,660 | B2 * | 10/2020 | Vabnick | F41B 9/0046 |
| 10,928,173 | B1 * | 2/2021 | Foltz | F42B 33/06 |
| 11,092,414 | B2 * | 8/2021 | Sasnett | F41A 25/00 |
| 11,243,038 | B1 * | 2/2022 | Langner | F41A 21/10 |
| 2009/0178548 | A1 * | 7/2009 | Tyas | F42B 33/062 86/50 |
| 2018/0259311 | A1 * | 9/2018 | Sasnett | F41A 23/02 |
| 2019/0316863 | A1 * | 10/2019 | Bowman | F42D 5/04 |
| 2021/0389107 | A1 * | 12/2021 | Vabnick | F42B 12/745 |

* cited by examiner

MODULAR DISRUPTION SYSTEMS FOR EXPLOSIVE ORDNANCE DISPOSAL

CROSS-REFERENCE TO RELATED APPLICATION

This application claims the benefit, under 35 U.S.C. § 119(e), of U.S. Provisional Patent Application No. 63/018,590, filed 1 May 2020, the entire contents and substance of which is incorporated herein by reference in its entirety as if fully set forth below.

BACKGROUND

Explosive Ordnance Disposal (EOD), sometimes referred to as bomb disposal, generally refers to systems and methods aiming to thwart or disrupt an explosive device, such that the explosive device is prevented from fully exploding. Certain systems may achieve this by targeting a specific portion or component of the explosive device with a disruptor device and discharging one or more projectiles from the disruption system or device such that the explosive device is rendered inoperable, thus preventing the explosive device from exploding (e.g., discharging a 12-gauge disruption projectile, such as from the Zero Point TiTAN).

Existing disruption systems, however, are typically designed to fire only a single size and/or geometry of projectile. For example, the Zero Point TiTAN is designed to discharge 12-gauge disruption ammunition. A given caliber (e.g., size and/or geometry) of ammunition, however, generally requires a very specific internal geometry (e.g., chamber throat geometry) of the disruption system itself. Thus, a user desiring to switch between ammunition calibers for EOD is typically required to carry into the field multiple different disruption systems, each configured to discharge a different caliber projectile, for example. Likewise, a user wishing to make use of developing technologies is generally required purchase new disruption systems with new geometries in the chamber throat, for example, as such changes necessitate barrel bore changes.

What is needed, therefore, is a disruption system capable of discharging multiple calibers of ammunition.

SUMMARY

These and other problems may be addressed by embodiments of the technology disclosed herein. Certain implementations include a bumper system for an Explosive Ordnance Disposal (EOD) disruptor.

The disclosed technology includes a modular disruption system. The modular disruption system can include one or more interchangeable barrel sections, and each interchangeable barrel section can be configured to support a different ammunition caliber. The modular disruption system can also include one or more interchangeable chamber sections, and each interchangeable chamber section can be configured to support a different ammunition caliber. Each interchangeable chamber section can be configured to detachably attach to each interchangeable barrel section. Accordingly, the flexibility of the overall disruption system is increased, as various ammunition calibers and chamber throat geometries can be provided via a single disruption system. For example, because the interchangeable chamber section and the interchangeable barrel section are separate, it is possible to change the chamber of the system without requiring a change of the barrel bore.

The disclosed technology includes a modular disruption system that includes a barrel section having a first end and a second end, and the barrel section can be to configure to guide a disruption projectile from the first end to the second end. The modular disruption system can include a chamber section having a first end and a second end, and the second end of the chamber section can be detachably attachable to the first end of the barrel section. The modular disruption system can include a breech portion detachably attachable to the first end of the chamber section, and the breech portion can be configured to initiate firing of the disruption projectile.

The breech portion can comprise an electric breech assembly.

The barrel section can be a first barrel section having first barrel characteristics, and the modular disruption system can include a second barrel section having a first end, a second end, and second barrel characteristics, where at least one of the second barrel characteristics is different from a corresponding one of the first barrel characteristics. The second end of the chamber section can be detachably attachable to the first end of the second barrel section.

The first barrel characteristics can comprise at least one of a first barrel bore characteristic or a first barrel length, and the second barrel characteristics comprises at least one of a second barrel bore characteristic or a second barrel length. The first barrel bore characteristic can be one of a smooth barrel bore or a rifled barrel bore, and the second barrel bore characteristic can be the other of the smooth barrel bore or the rifled barrel bore.

The chamber section can be a first chamber section having a first chamber throat geometry, and the modular disruption system can include a second chamber section having a first end, a second end, and a second chamber throat geometry that is different from the first chamber throat geometry. The second end of the second chamber section can be detachably attachable to the first end of the barrel section.

The barrel extension can have a first end and a second end, and the first end of the barrel extension can be detachably attachable to the second end of the barrel section.

The barrel extension can be a first barrel extension having first barrel characteristics, and the modular disruption system can include a second barrel extension having a first end, a second end, and second barrel characteristics. At least one of the second barrel characteristics can be different from a corresponding one of the first barrel characteristics, and the first end of the second barrel extension being detachably attachable to the second end of the barrel section.

The modular disruption can include one or more barrel accessories, and each of the one or more barrel accessories being detachably attachable to the second end of the first barrel section, the second barrel section, the first barrel extension, and/or the second barrel extension. The one or more barrel accessories can include a barrel thread cap or a muzzle brake.

The disclosed technology includes a modular disruption kit for explosive ordnance disposal, and the modular disruption kit can include a first barrel section, a second barrel section, a first chamber section, a second chamber section, and a breech portion. The first barrel section can be configured to guide a disruption projectile along a length of the first barrel section, and the first barrel section can have a first barrel bore characteristic and a first barrel length. The second barrel section can be configured to guide the disruption projectile along a length of the second barrel section, and the second barrel section can have a second barrel bore characteristic and a second barrel length. The second barrel bore characteristic can be different from the first barrel bore characteristic, and/or the second barrel length can be different from the second barrel length. The first chamber section can be detachably attachable to at least one of the first barrel section or the second barrel section, and the first chamber section can have a first chamber throat geometry. The second chamber section can be detachably attachable to at least one of the first barrel section or the second barrel section, and the second chamber section can have a second chamber throat geometry that is different from the first chamber throat geometry. The breech portion can be detachably attachable to at least one of the first chamber section or the second chamber section, and the breech portion can be configured to initiate firing of the disruption projectile.

Other embodiments, implementations, features, and aspects of the disclosed technology are described in detail herein and are considered a part of the disclosed technology. Other embodiments, implementations, features, and aspects can be understood with reference to the following detailed description, accompanying drawings, and claims.

BRIEF DESCRIPTION OF THE FIGURES

Reference will now be made to the accompanying figures, which are not necessarily drawn to scale, and wherein.

DETAILED DESCRIPTION

Figure 1:
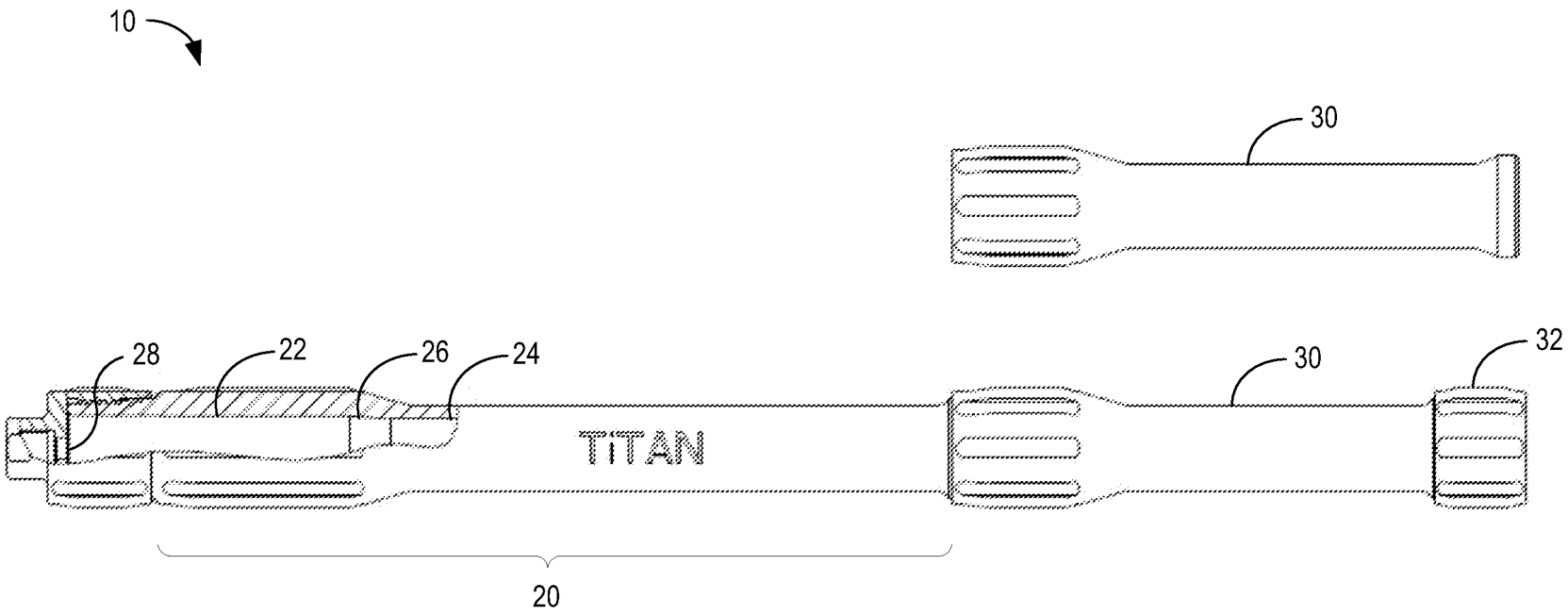
FIG. 1 PRIOR ART
FIG. 1 illustrates an existing disruption system.

Throughout this disclosure, certain implementations are described modular disruption systems, which can be used for EOD tasks. Moreover, certain implementations can support multiple ammunition calibers via a single disruption system.

Some implementations of the disclosed technology will be described more fully hereinafter with reference to the accompanying drawings. This disclosed technology may, however, be embodied in many different forms and should not be construed as limited to the implementations set forth therein.

In the following description, numerous specific details are set forth. But it is to be understood that implementations of the disclosed technology may be practiced without these specific details. In other instances, well-known methods, structures, and techniques have not been shown in detail in order not to obscure an understanding of this description. References to "one implementation," "an implementation," "example implementation," "some implementations," "certain implementations," "various implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

As explained above, disruption systems are useful for thwarting or disrupting an explosive device, thereby preventing the explosive device from fully exploding. Typically, disruption devices achieve this by firing a projectile (e.g., discharging a 12-gauge disruption projectile, such as from the Zero Point TiTAN) at a specific portion or component of the explosive device such that the explosive device is rendered inoperable and thus unable to explode. Because disruption systems are typically carried into the field by a user, transportability is often an important attribute for a disruption system. Thus, disruption systems are often engineered to be as small and as light as possible (e.g., disruptors often include as few components as possible). To aim the disruption system and/or absorb recoil experienced by the disruption system upon firing of the projectile, disruption devices and/or systems can be attached to a separate device or apparatus (e.g., a device or apparatus that has sufficient mass to absorb much of the recoil energy of the disruptor). For example, some disruptor systems can include and/or be detachably attachable to a robot or a stand. The robot or stand can be capable of absorbing enough energy from the recoil such that the disruptor, robot, and/or stand are preventing from being launched toward surrounding persons or objects.

While disruption systems have proven to be useful for EOD, limitations with existing systems exist. Referring to FIG. 1 as an example, existing systems 10 typically include a main barrel portion 20, which can include a fixed chamber 22 and a fixed barrel bore 24 with a fixed throat geometry 26 serving to transition between the fixed chamber 22 and the fixed barrel bore 24. Existing systems 10 also typically include a fixed breech assembly 28 to fire the ammunition in the fixed chamber 22. Existing systems 10 can also include barrel extensions 30 (e.g., smooth bore extensions, rifled bore extensions) and/or barrel accessories 32.

Existing systems 10, however, are typically compatible with only a single ammunition type or caliber. This is because, for example, the use of different ammunition calibers would require changes to at least the fixed chamber 22, the fixed barrel bore 24, and/or the fixed throat geometry 26. And while there are certain ammunition calibers that seem to be used in most scenarios (e.g., 12 gauge ammunition), certain tactical situations may arise in which use of a different caliber of ammunition would be advantageous or required. To account for such situations, users have been required to carry into the field multiple disruption systems 10 to provide different caliber capabilities.

Figure 2:
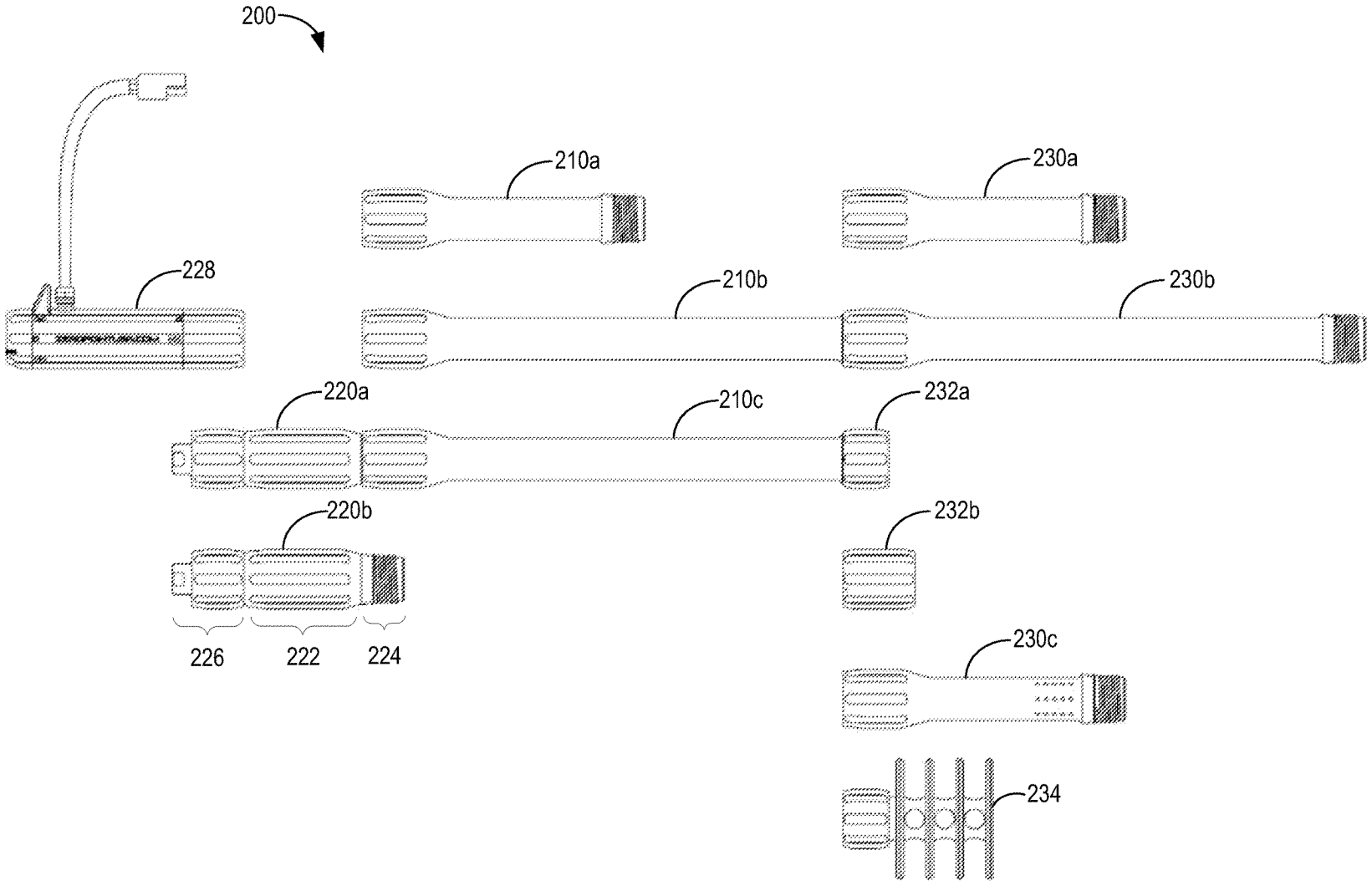
FIG. 2 illustrates an example modular disruption system, in accordance with the disclosed technology.

Referring now to FIG. 2, the disclosed technology includes a modular disruption system 200 that can include one or more interchangeable barrel sections 210 (e.g., interchangeable barrel sections 210*a*, 210*b*, 210*c*, or the like) and one or more interchangeable chamber sections 220 (e.g., chamber sections 220*a*, 220*b*, or the like). As indicated with respect to interchangeable chamber section 220*b*, each interchangeable chamber section 220 can include a chamber 222 and a chamber throat geometry 224. The chamber throat geometry 224, which is located on an internal surface of the interchangeable chamber section 220, can facilitate a transition between the chamber 222 and the barrel bore of a connected interchangeable barrel section 210. The interchangeable chamber section 220 can include a breech portion 226. Alternatively or in addition, some or all of the breech portion 226 can be detachably attachable to the end of the interchangeable chamber section 220 (e.g., via threaded ends of either component) that is opposite the end of the chamber throat geometry 224. The breech portion 226 can include a breech and a breech cap to cover the breech and/or detachably attach the breech to the interchangeable chamber section 220 The breech can be configured to receive a signal from a fuse or the like, which can cause the breech to initiate firing of the projectile. The breech can at least partially insert into the end of the interchangeable chamber section, and the breach cap can at least partially cover the breech to hold the breech in contact with the interchangeable chamber section 220. Optionally, multiple breech portions 226 or breech assemblies can be provided. For example, an electric breech assembly 228 can be detachably attachable to the interchangeable chamber section 220. The electric breech assembly 228 can be configured to receive an electric signal, either wirelessly or via a wire, and can be configured to initiate firing of an ammunition round in response to receiving the electric signal.

One, some, or all of the interchangeable chamber sections 220 and/or one, some, or all of the interchangeable barrel sections 210 can be configured to support a corresponding ammunition caliber. One, some, or all of the interchangeable chamber sections 220 can have different chamber throat geometries. Further, one, some, or all of the interchangeable barrel sections 210 can have different barrel bore characteristics or other characteristics (e.g., barrel length). For example, interchangeable barrel section 210*a* can have a smooth barrel bore, whereas interchangeable barrel section 210*b* can have a rifled barrel bore.

The interchangeable chamber section 220 can be configured to detachably attach to the interchangeable barrel section 210. For example, the interchangeable chamber section 220 can be configured to detachably attach to the interchangeable barrel section 210 via threaded ends of either component. When connected, an end of the interchangeable barrel section 210 can receive a portion of the interchangeable chamber section 220, and at least some of the portion of the interchangeable chamber section 220 positioned inside the interchangeable barrel section 210 can include at least a portion of the chamber throat geometry 224.

The modular disruption system 200 can provide two or more caliber offerings using a single interchangeable barrel section 210 by including two or more interchangeable chamber sections 220 of different calibers. The interchangeable chamber sections 220 of different calibers can be detachably attached to the interchangeable barrel section 210, thereby changing the caliber of the overall modular disruption system 200.

The modular disruption system 200 can include one or more interchangeable barrel extensions 230 (e.g., interchangeable barrel extensions 230*a*, 230*b*, 230*c*, or the like). One, some, or all of the interchangeable barrel extensions 230 can have different barrel bore characteristics or other characteristics (e.g., barrel length). For example, interchangeable barrel extension 230*a* can have a smooth barrel bore, whereas interchangeable barrel extension 230*b* can have a rifled barrel bore.

The modular disruption system 200 can include one or more barrel accessories. The barrel accessories can include barrel thread caps 232 that are configured to detachably attach to the end of the interchangeable barrel section 210. The barrel thread caps 232 can be configured to cover and protect the threads of the interchangeable barrel section 210 and/or interchangeable barrel extension 230. Alternatively or in addition, the barrel accessories can include a muzzle brake 234, which can detachably attach to the end of the interchangeable barrel section 210 and/or interchangeable barrel extension 230, and which can redirect (e.g., radially outward from the central axis of the interchangeable barrel section 210 attached components) a portion of propellant gases. This can serve to reduce recoil and/or muzzle rise, for example. The aforementioned barrel accessories are non-limiting and are included for illustrative purposes only. The modular disruption system 200 can include one, some, all, or none of the described barrel accessories, as well other barrel accessories not expressly described herein.

The various components described herein as being "detachably attachable" can be configured to connect to, and disconnect from, an adjacent component (e.g., via threaded ends of either component). While certain components are depicted as including a male end or a female end, the opposite can be true. For example, the interchangeable chamber sections 220 are shown as having a male threaded end proximate the chamber throat geometry 224 (see interchangeable chamber section 220*b*) and attaching to a female threaded end of an interchangeable barrel section 210 (see the attachment of interchangeable chamber section 220*a* to interchangeable barrel section 210*c*). However, these components can have the opposite configuration: the interchangeable chamber sections 220 can have a female threaded end proximate the chamber throat geometry 224 to attach to a male threaded end of an interchangeable barrel section 210, as a non-limiting example. Moreover, other detachable attachment mechanisms are contemplated, such as, for example, releasable clasps.

The interchangeable barrel sections 210, interchangeable chamber sections 220, breech portions 226, interchangeable barrel extensions 230, and/or barrel accessories can each have a central axis. The central axis of some or all of these components can be aligned, or approximately aligned, when the components are attached to one another to form an assembled disruptor device. Alternatively or in addition, each of these components can have a center of mass, and when a disruptor device is assembled, the center of mass for each of the barrel section 210, the chamber section 220, and the breech portion 226 can be located on or near a common axis. Optionally, the center of mass for an attached barrel accessory can also be located on or near the common axis.

Example Use Case

A user can desire to have EOD disruption capabilities that include two or more ammunition calibers while the user is in the field. Such a user can carry a disruption system in accordance with the disclosed technology (e.g., disruption system 200). The disruption system can include separate barrel and chamber sections (e.g., interchangeable barrel section 210 and interchangeable chamber section 220). Thus, the disruption system can provide two ammunition calibers, for example, by including a barrel section and two chamber sections of different calibers. By detachably attaching the different chamber sections to the barrel section, the user can change the caliber offered by the disruption system.

While certain implementations of the disclosed technology have been described in connection with what is presently considered to be the most practical implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

What is claimed is:

1. A modular disruption system for explosive ordnance disposal, the modular disruption system comprising:

a first barrel section having a first end and a second end and having first barrel characteristics and first barrel dimensions;

a second barrel section having a first end and a second end, the first barrel section and the second barrel section being configured to guide a disruption projectile from the first end of each barrel section to the second end of each barrel section, the second barrel section having second barrel characteristics and second barrel dimensions, at least one of the second barrel characteristics being different from a corresponding one of the first barrel characteristics;

a first chamber section having a first end and a second end, the first chamber section having a first chamber caliber with a first chamber throat geometry to transition the first chamber caliber to the first barrel dimensions of the first barrel section, the second end of the first chamber section being detachably attachable to the first end of the first barrel section;

a second chamber section having a first end and a second end, the second chamber section having second chamber caliber that is different from the first chamber caliber with a second chamber throat geometry that is different from the first chamber throat geometry to transition the second chamber caliber to the first barrel dimensions of the first barrel section, the second end of the second chamber section being detachably attachable to the first end of the second barrel section; and a breech portion detachably attachable to the first end of the first chamber section and the first end of the second chamber section, the breech portion being configured to initiate firing of the disruption projectile.

2. The modular disruption system of claim 1, wherein the breech portion comprises an electric breech assembly.

3. The modular disruption system of claim 1, wherein:

the first barrel characteristics comprises at least one of a first barrel bore characteristic or a first barrel length, and the second barrel characteristics comprises at least one of a second barrel bore characteristic or a second barrel length.

4. The modular disruption system of claim 3, wherein the first barrel bore characteristic is one of a smooth barrel bore or a rifled barrel bore and the second barrel bore characteristic is the other of the smooth barrel bore or the rifled barrel bore.

5. The modular disruption system of claim 1, wherein the first chamber section and the second chamber section are configured to guide the disruption projectile from the first end of the first chamber section to the second end of the second chamber section when the second end of the first chamber section and the first end of the second chamber section are detachably attached.

6. The modular disruption system of claim 1 further comprising:

a barrel extension having a first end and a second end, the first end of the barrel extension being detachably attachable to the second end of the second barrel section.

7. The modular disruption system of claim 6, wherein the barrel extension is a first barrel extension having first barrel characteristics, the modular disruption system further comprising:

a second barrel extension having a first end, a second end, and second barrel characteristics, at least one of the second barrel characteristics being different from a corresponding one of the first barrel characteristics, the first end of the second barrel extension being detachably attachable to the second end of the second barrel section.

8. The modular disruption system of claim 1 further comprising:

one or more barrel accessories, each of the one or more barrel accessories being detachably attachable to the second end of the second barrel section.

9. The modular disruption system of claim 8, wherein the one or more barrel accessories comprises a barrel thread cap or a muzzle brake.

10. The modular disruption system of claim 8 further comprising:

a barrel extension having a first end and a second end, the first end of the barrel extension being detachably attachable to the second end of the second barrel section, wherein the one or more barrel accessories are detachably attachable to the second end of the barrel extension.

11. The modular disruption system of claim 1, wherein the first chamber throat geometry is further configured to transition the first chamber caliber to the second barrel dimensions, and the second chamber throat geometry is further configured to transition the second chamber caliber to the second barrel dimensions, the first barrel dimension and the second barrel dimensions being equal.

12. A modular disruption system for explosive ordnance disposal, the modular disruption system comprising:

a first barrel section and a second barrel section, each of the first barrel section and the second barrel section (i) having a first end and a second end, (ii) a barrel dimensions that are the same for the first barrel section and the second barrel section, and (iii) being configured to guide a disruption projectile from the first end to the second end;

a first chamber section and a second chamber section, the first chamber section having (i) a first end, (ii) a second end that is detachably attachable to the first end of either the first barrel section or the second barrel section, and (iii) a first chamber caliber with a first chamber throat geometry to transition the first chamber caliber to the barrel dimensions, the second chamber section having (i) a first end, (ii) a second end that is detachably attachable to the first end of either the first barrel section or the second barrel section, and (iii) a second chamber caliber with a second chamber throat geometry that is different from the first chamber throat geometry to transition the second chamber caliber to the barrel dimensions; and a breech portion detachably attachable to at least one of the first end of the first chamber section or the first end of the second chamber section, the breech portion being configured to initiate firing of the disruption projectile.

13. The modular disruption system of claim 12, wherein the breech portion comprises an electric breech assembly.

14. The modular disruption system of claim 12, wherein the first barrel section has first barrel characteristics and the second barrel section has second barrel characteristics, at least one of the second barrel characteristics being different from a corresponding one of the first barrel characteristics.

15. The modular disruption system of claim 14, wherein:

the first barrel characteristics comprises at least one of a first barrel bore characteristic or a first barrel length, and the second barrel characteristics comprises at least one of a second barrel bore characteristic or a second barrel length.

16. The modular disruption system of claim 15, wherein the first barrel bore characteristic is one of a smooth barrel bore or a rifled barrel bore and the second barrel bore characteristic is the other of the smooth barrel bore or the rifled barrel bore.

17. The modular disruption system of claim 12, wherein the first chamber section and the second chamber section are configured to guide the disruption projectile from the first end of the first chamber section to the second end of the second chamber section when the second end of the first chamber section and the first end of the second chamber section are detachably attached.

18. The modular disruption system of claim 12 further comprising:

one or more barrel extensions, each of the one or more barrel extensions having (i) a first end detachably attachable to at least one of the second end of the first barrel section or the second end of the second barrel section and (ii) a second end.

19. The modular disruption system of claim 12 further comprising:

one or more barrel accessories, each of the one or more barrel accessories being detachably attachable to at least one of the second end of the first barrel section or the second end of the second barrel section.

20. A modular disruption kit for explosive ordnance disposal, the modular disruption kit comprising:

a first barrel section configured to guide a disruption projectile along a length of the first barrel section, the first barrel section having a first barrel bore characteristic and a first barrel length;

a second barrel section configured to guide the disruption projectile along a length of the second barrel section, the second barrel section having a second barrel bore characteristic and a second barrel length, wherein the second barrel bore characteristic is different from the first barrel bore characteristic or the second barrel length is different from the second barrel length;

a first chamber section that is detachably attachable to either the first barrel section or the second barrel section, the first chamber section having first chamber caliber with a first chamber throat geometry;

a second chamber section that is detachably attachable to either the first barrel section or the second barrel section, the second chamber section having second chamber caliber different from the first chamber caliber with a second chamber throat geometry that is different from the first chamber throat geometry; and a breech portion detachably attachable to at least one of the first chamber section or the second chamber section, the breech portion being configured to initiate firing of the disruption projectile.

* * * * *